US008011511B2

(12) United States Patent
Oyler et al.

(10) Patent No.: US 8,011,511 B2
(45) Date of Patent: Sep. 6, 2011

(54) PACKING MATERIAL AND METHOD

(75) Inventors: Max D. Oyler, Louisville, KY (US); William Kennet Oyler, III, Louisville, KY (US); Michael J. Lyons, Louisville, KY (US); Ron Smith, Louisville, KY (US); Charles W. Woods, II, Louisville, KY (US)

(73) Assignee: Simpak International LLC, Louisville, KY (US)

( * ) Notice: Subject to any disclaimer, the term of this patent is extended or adjusted under 35 U.S.C. 154(b) by 216 days.

(21) Appl. No.: 12/368,761

(22) Filed: Feb. 10, 2009

(65) Prior Publication Data

US 2009/0199513 A1 Aug. 13, 2009

Related U.S. Application Data

(60) Provisional application No. 61/027,565, filed on Feb. 11, 2008.

(51) Int. Cl.
*B65D 81/02* (2006.01)

(52) U.S. Cl. ..... 206/523; 206/524.8; 206/584; 206/591

(58) Field of Classification Search ..... 206/521, 206/524.8, 584, 586, 587, 591, 592, 523; 428/158, 161, 163, 167, 156
See application file for complete search history.

(56) References Cited

U.S. PATENT DOCUMENTS

| | | | | |
|---|---|---|---|---|
| 1,781,797 | A | 11/1930 | Williams | |
| 5,206,069 | A * | 4/1993 | Horiki et al. | 428/167 |
| 5,515,975 | A * | 5/1996 | Jarvis et al. | 206/584 |
| 5,636,744 | A * | 6/1997 | Hirose | 206/586 |
| 5,788,078 | A * | 8/1998 | Fuss | 206/521 |
| 6,085,909 | A | 7/2000 | Lyons | |
| 7,387,203 | B2 * | 6/2008 | Siecke | 206/312 |

FOREIGN PATENT DOCUMENTS

| | | |
|---|---|---|
| DE | 92 11 531 | 12/1992 |
| DE | 94 19 899 | 3/1995 |
| FR | 1 215 270 | 4/1960 |

* cited by examiner

*Primary Examiner* — Luan K Bui
(74) *Attorney, Agent, or Firm* — Theresa Fritz Camoriano; Guillerad Camoriano; Camoriano and Associates

(57) ABSTRACT

A packing material is made of a thin plastic bag with compressible beads inside, and with the pressure inside the bag being sufficiently less than the ambient pressure outside the bag to keep the beads in a non-free-flowing state, the packing material being generally flat, with a generally constant cross-sectional thickness and having at least one trough of lesser cross-sectional thickness to serve as a bend line.

4 Claims, 4 Drawing Sheets

PACKING MATERIAL AND METHOD

BACKGROUND

This application claims priority from U.S. patent application Ser. No. 61/027,565, filed Feb. 11, 2008, which is hereby incorporated herein by reference. The present invention relates to packing material and methods for protecting articles to be shipped and is a further development of the product described in U.S. Pat. No. 6,085,909 (the '909 patent), which is hereby incorporated herein by reference.

The '909 patent teaches a reusable flexible packing bag that is filled with free-flowing beads, such as expanded polystyrene beads. The air is evacuated from the bag, and then the bag is sealed so that the internal pressure inside the bag is less than the external pressure from the ambient air. The pressure differential is enough to prevent the beads from flowing freely. Instead, they remain closely packed, and the bag maintains its shape. The bag preferably is formed into a flat shape before it is sealed, so the result is a substantially flat packing material that generally keeps its shape but that can be bent to wrap around an article to be packaged in order to conform to the contour of the article or of the package to cushion the article during shipping.

As explained above, the pressure differential between the ambient pressure acting on the outside of the packing bag and the pressure acting on the inside of the bag after it is sealed is sufficient to maintain the beads in a non-free-flowing condition. It is preferred that the pressure differential be at least 0.3 pounds per square inch and more preferable that is be at least 0.5 pounds per square inch. Since the ambient atmospheric pressure is usually 14.7 pounds per square inch, the internal pressure inside the bag preferably is no greater than 14.4 pounds per square inch and more preferably not greater than 14.2 pounds per square inch.

While the packing materials described in the '909 patent are readily used to wrap around a product or to fit along the inside of a box to protect against damage during shipping, the proper placement of the packing material depends upon the skill and judgment of the person who is placing it and therefore may not be consistently reproduced. Also, it takes time to properly position the packing.

SUMMARY

The embodiments of the invention described below improve over the teaching of the '909 patent by making it easier to place the packing properly, so the placement is easily repeatable and may be done very quickly while still ensuring that the product is well-protected.

In a preferred embodiment, while the packing generally is flat and has a consistent cross-section thickness, there also is at least one thinner cross-section trough area formed in the packing to serve as a bend line.

DESCRIPTION

Figure 1:
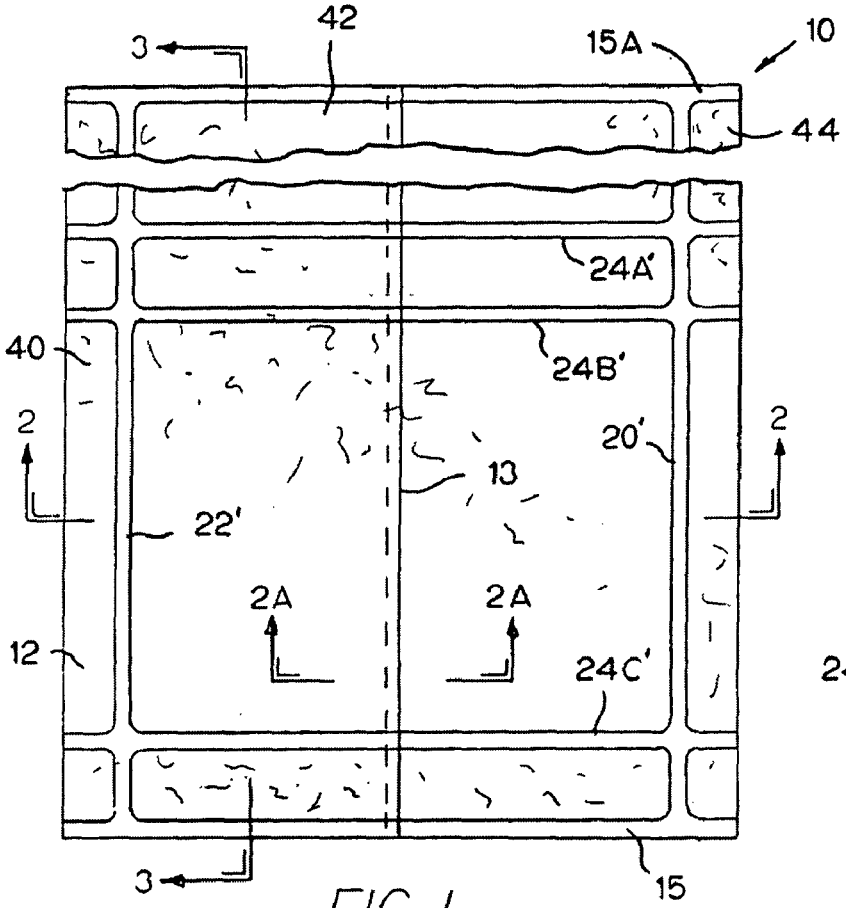
FIG. 1 is a partially broken away plan view of a packing material made in accordance with the present invention.

FIGS. 1-9A show a first embodiment of a packing material 10 made of a thin plastic bag 12 with compressible beads 14 inside. The bag 12 is made of a material that is air tight, so a lower pressure can be maintained inside the bag than outside the bag. For ease of manufacturing, it also is preferable for the bag 12 to be made of a thermoplastic material so it can be sealed shut using heat, such as by using a heated wire or bar. However, other materials and other sealing mechanisms could be used instead, such as ultrasonic welding, chemical welding, adhesive, and so forth. Some preferred thermoplastic materials that may be used to make the bag include polyethylene, polypropylene, and nylon. The beads 14 preferably are made of an expanded material with air pockets which can be compressed and which then will tend to spring back, such as expanded polystyrene.

One method of producing the packing material 10 is to use a Vertical Form Fill and Seal machine (VFFS), which takes the thin plastic sheet material 12, forms it into a cylinder by overlapping the edges of the plastic sheet and sealing them together along the vertical seam 13, seals the thin plastic sheet together horizontally to form the bottom edge 15 of the bag, and then fills the bag 12 with the beads 14.

A few modifications have been made to a standard VFFS machine, such as a Triangle, Hayssen, Matrix Pro, or Universal Packaging Series 1500 machine, in order to produce the packing material 10.

Figure 5:
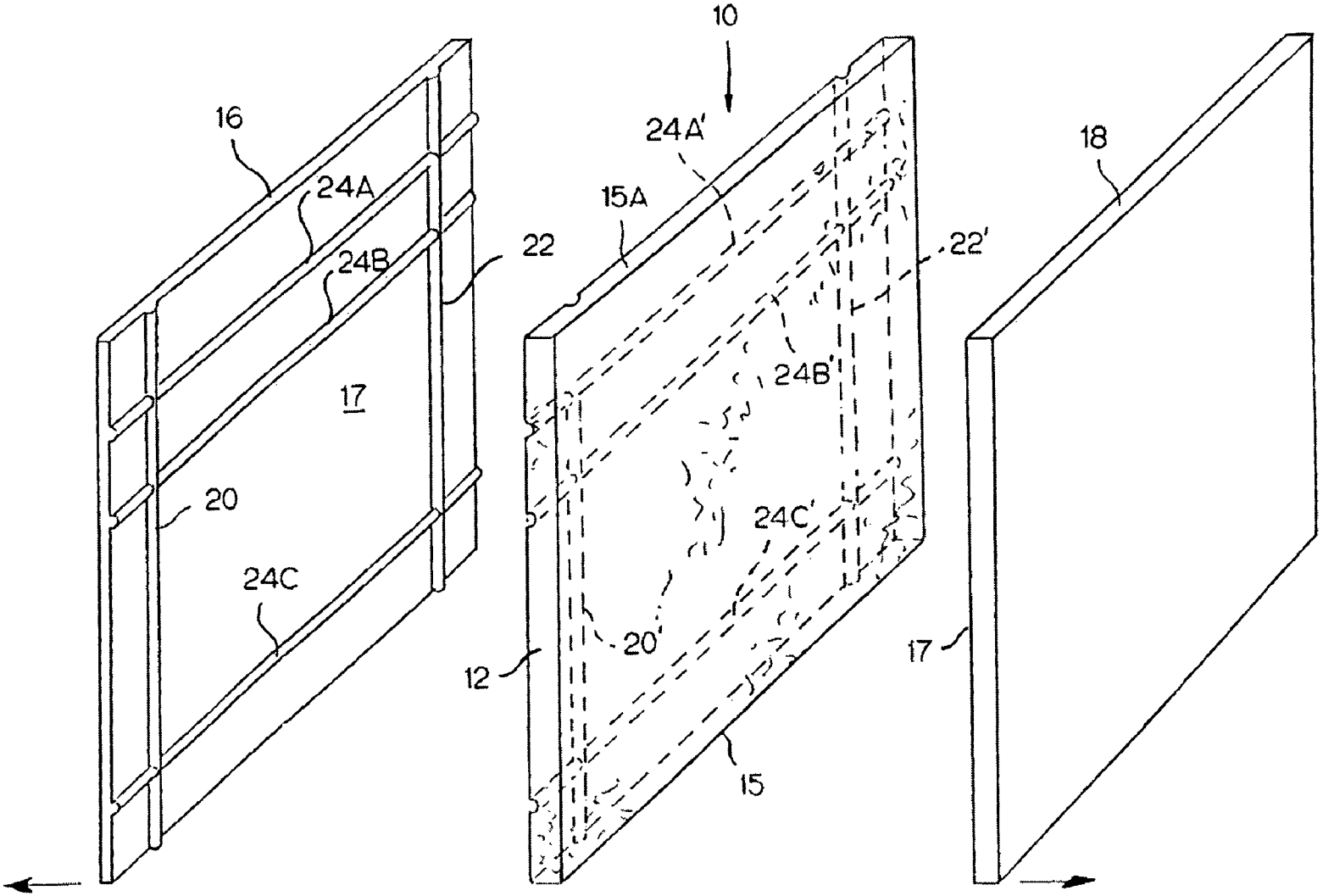
FIG. 5 is a schematic exploded perspective view showing the platens that help form the packing material.

As shown schematically in FIG. 5, a pair of parallel vertical plates or platens 16, 18, movable in the horizontal direction by means of hydraulic cylinders (not shown), has been added to the standard machine in order to make a squeezer assembly, which compresses the bag 12 after it has been filled with beads 14 but before the top edge 15A of the bag 12 is sealed.

In this embodiment, both of the platens 16, 18 present a generally flat surface 17 to the bag 12, but one platen 16 has elongated raised portions 20, 22, 24A-C, which project inwardly toward the bag 12 from the generally flat surface 17. In this particular embodiment, these raised portions are raised approximately one-half inch from the generally flat surface 17 along their fall length. While these raised portions are formed as elongated, straight lines (having an arched cross-section), other elongated shapes of raised portions could be used, if desired, to form elongated troughs that will help the packer bend the packing following the contour of a particular product or box.

Once the bag 12 has been filled with beads 14, the platens 16, 18 of the squeezer assembly are moved toward each other to flatten and compress the bag 12 and the beads 14, evacuating the air from the inside of the bag 14. In this particular embodiment, the generally flat surfaces 17 of the opposed platens 16, 18 are moved toward each other during the squeezing process until they are about one and one-half inches apart (and the raised portions 20, 22, 24A-C on the platen 16 are about one inch from the flat surface 17 of the opposite platen 18, forming trough portions 20', 22', 24A'-C' with a cross-section that is one inch thick while the adjacent constant cross-section area of the packing bag is one-and-one-half inches thick). Of course, the thickness of the constant cross-section flat portion of the packing material 10 and the thickness of the troughs may be adjusted as desired for various product and package arrangements.

Figure 3:
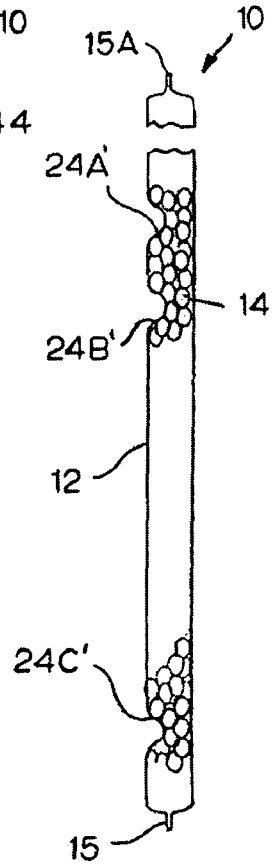
FIG. 3 is a section view taken along line 3-3 of FIG. 1.
Figure 2:
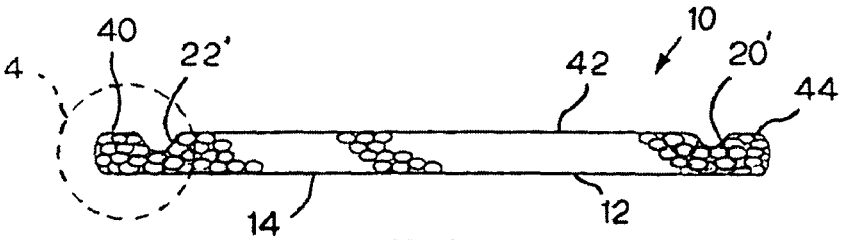
FIG. 2 is a section view taken along line 2-2 of FIG. 1.
Figure 2A:
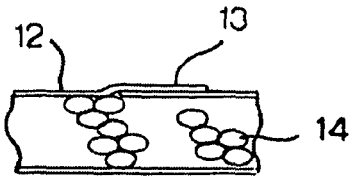
FIG. 2A is an enlarged section view taken along the line 2A-2A of FIG. 1.
Figure 4:
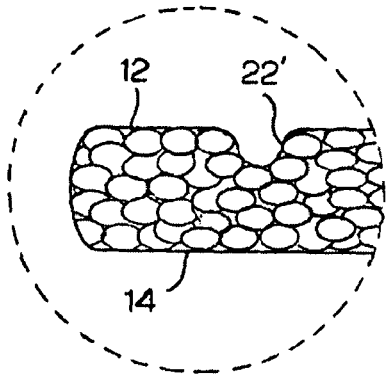
FIG. 4 is an enlarged portion of the left side of FIG. 2.

As shown in the section views of FIGS. 2-4, there are fewer beads 14 in the cross section of the trough areas than in the generally constant cross-sectional thickness areas. For example, in FIG. 4, there are approximately six beads in the thickness of the generally constant cross-section area and approximately four beads in the thickness of the trough 22'. This makes it easier to bend the packing material along the trough 22' while still providing protection even in the area of the trough 22'. By making the trough 22' about two/thirds as thick as the generally constant cross-sectional thickness area, it is easier to bend the packing material 10 along the trough 22'.

While the platens 16, 18 are compressing the bag 12, the top edge 15A of the bag 12 is sealed shut, using a heat sealing bar, which results in a reduced internal pressure in the bag 12 that is substantially less than the ambient air pressure acting on the outside of the bag 12. In this particular case, the internal pressure inside the bag is 14.0 pounds per square inch, while the ambient pressure is 14.7 pounds per square inch. The portions of the plastic sheet that are heat sealed together to close off the top edge 15A of the bag 12 form a web, which also provides the bottom edge 15 of the next bag (not shown) that is being formed above it. The bags 12 may be cut apart at the web, or they may be kept together to form an interconnected string of bags, if desired. The bags 12 may all be made the same length, or they may be made different lengths, if desired.

In this embodiment, the elongated raised portions 20, 22 on the platen 16 are parallel and extend in the vertical direction, and the elongated raised portions 24A-C are horizontal, extending perpendicular to the parallel raised portions 20, 22. When the platens 16, 18 compress the bag 12, they push beads 14 out of the areas of the raised portions 20, 22, 24A-C and into the adjacent areas, resulting in a packing material that has a generally uniform cross-sectional thickness of about one-and-one-half inches (approximately six beads across) but has a thinner cross-sectional trough in the areas of the raised portions 20, 22, 24A-C of about one inch (approximately four beads across). As was explained above, the resulting bag 12 has fewer beads in cross-section in the thinner cross-section trough areas 20', 22', 24A-C' that were formed by the raised portions 20, 22, 24A-C, respectively, than it has in the thicker, generally uniform cross-section areas. Of course, the size and number of the beads 14 and the thickness and contour of the bag and troughs may be selected as desired, depending upon the configuration of the product to be packed.

When the top edge 15A of the bag 12 is sealed, the pressure differential between the ambient pressure outside the bag 12 and the pressure inside the bag 12 holds the beads 14 in position, so they are non-free-flowing. The packing material remains flat, with the troughs 20', 22', 24A-C' remaining in their original positions.

While the troughs 20', 22', 24A-C' in this embodiment are oriented vertically and horizontally, they could be located and oriented in any desired position and direction suitable for the application, and they could follow an arcuate path or some other path besides a straight line, if desired. Of course, the raised portions on the platens would be changed accordingly in order to form the desired troughs.

FIGS. 6-9A show the packing material 10 being used to pack a laptop computer 28 in a box 30. While a laptop computer 28 is being shown here, it is understood that the same type of arrangement could be used for packing other products, adjusting the dimensions and the number and arrangement of the troughs according to the dimensions and shape of the product being packed, as desired.

In this embodiment, the two parallel lengthwise troughs 20', 22' form the boundaries of first, second, and third adjacent constant cross-section portions 40, 42, 44, respectively. The second constant cross-section portion 42 is wider than the first and third portions 40, 44. The box 30 has a rectangular bottom 50, with rectangular left, right, front and rear sides 52, 54, 56, 58, projecting upwardly from the bottom 50 along straight edges 62, 64, 66, 68, respectively.

Figure 6:
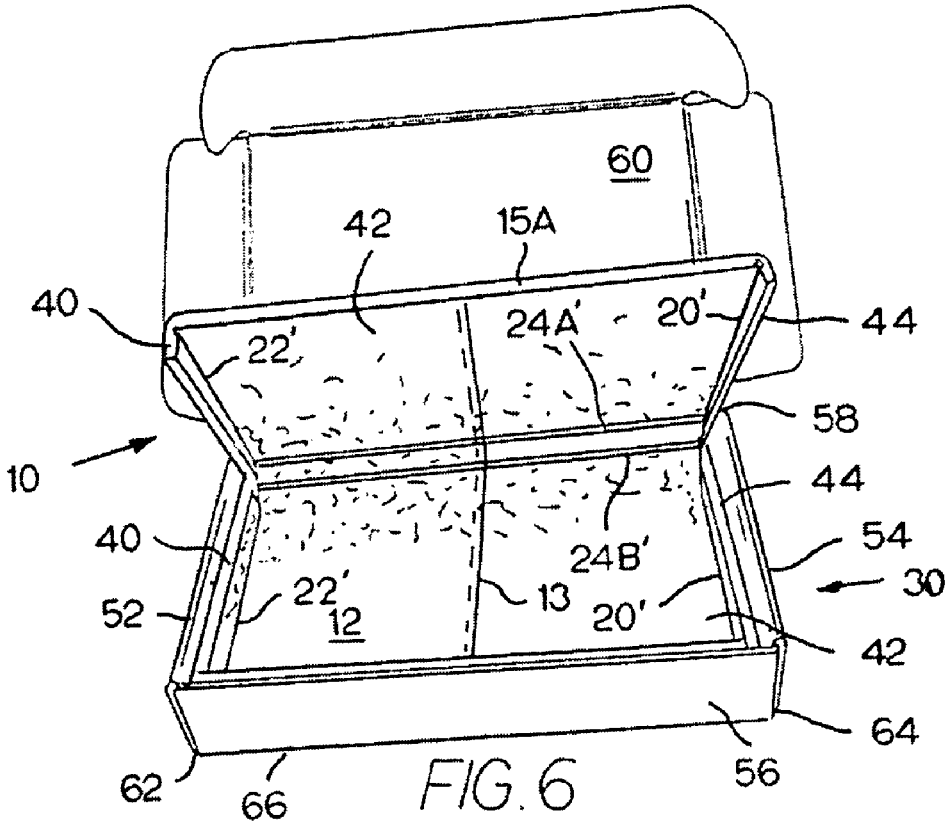
FIG. 6 is a perspective view showing a box with the packing material of FIG. 1 inside.
Figure 7:
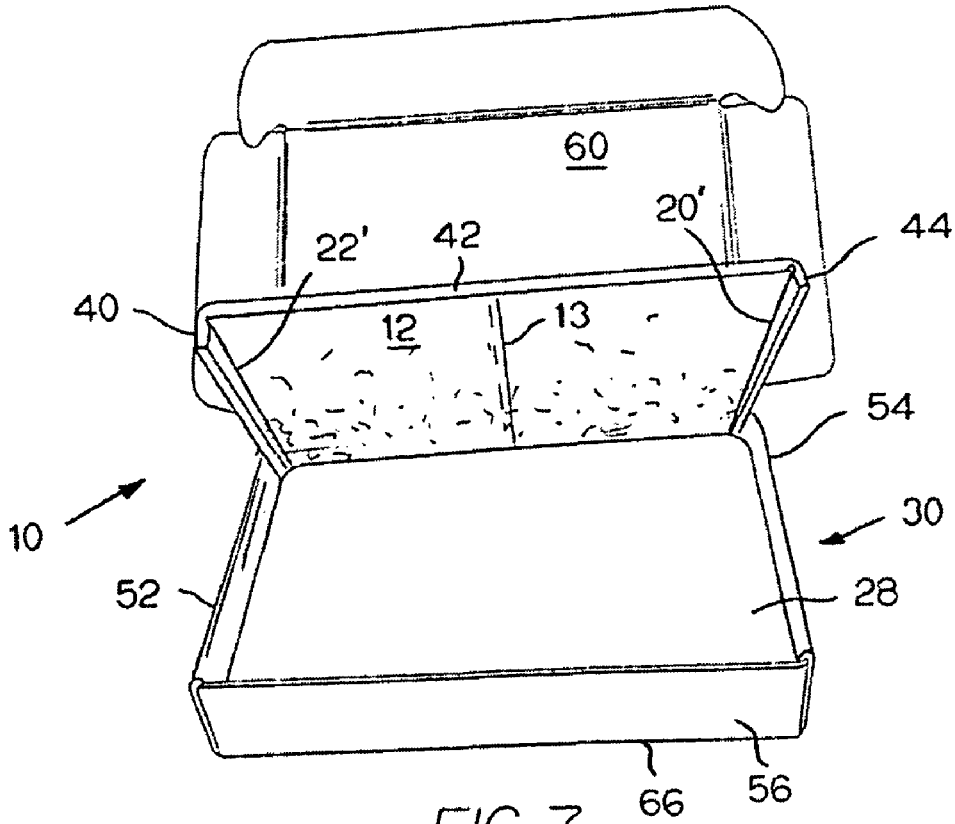
FIG. 7 is the same view as FIG. 6 but with a product on top of the packing material.
Figure 8:
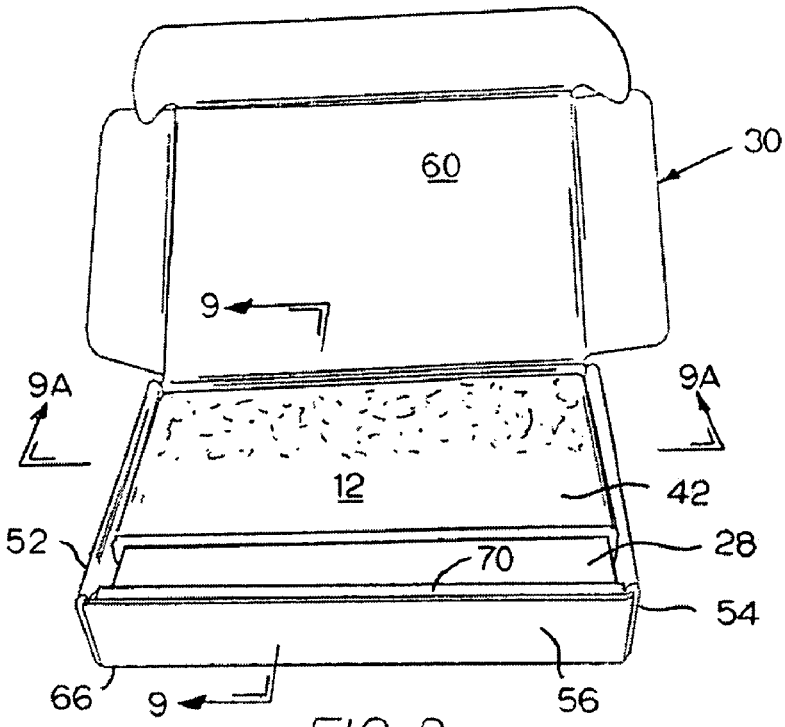
FIG. 8 is the same view as FIG. 7 but with the packing material wrapped further around the product.

As shown in FIG. 6, the central portion 42 of the packing material 10 covers the bottom 50 of the box 30, and the left and right portions 40, 44 extend upwardly along the left and right sides 52, 54, respectively, with the packing material 10 being bent along the troughs 20', 22', which lie along the edges 64, 62, respectively.

Figure 9:
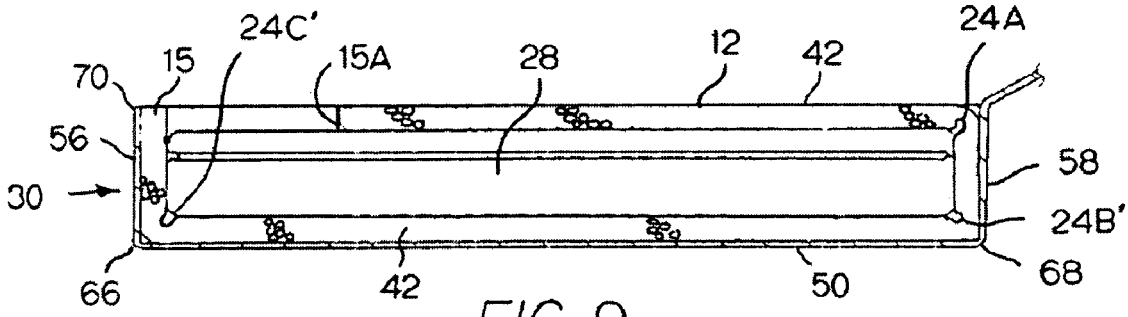
FIG. 9 is a section view taken along line 9-9 of FIG. 8.

As shown in FIG. 9, the bottom edge 15 of the packing material 10 lies adjacent to the top edge 70 of the front side 56 of the box 30. The trough 24B' lies along the bottom rear edge 68, and the trough 24C' lies along the bottom front edge 66 of the box 30.

The packing 10 is wrapped around the back of the laptop 28, with the trough 24A' lying along the top rear edge of the laptop 28. The remainder of the central portion 42 of the packing material 10 lies on top of the laptop 28.

Figure 9A:
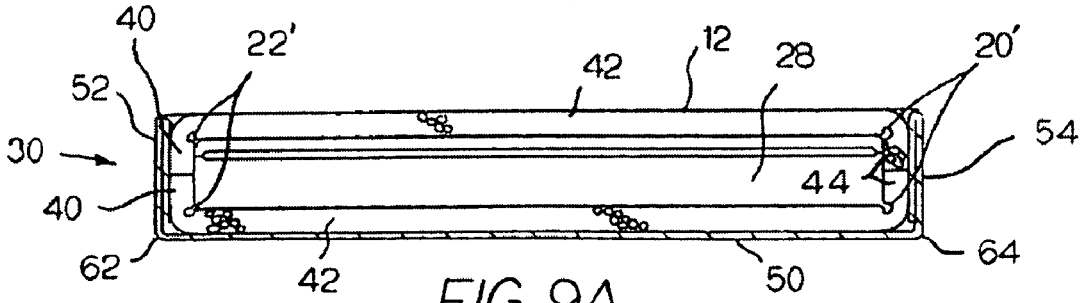
FIG. 9A is a section view taken along line 9A-9A of FIG. 8.

As shown in FIG. 9A, the trough 22' lies along the ledge 66 of the bottom of the box. 30 and extends over the top left edge of the laptop 28. The trough 20' lies along the right edge 64 of the bottom of the box 30 and extends over the top right edge of the laptop 28. The portion 40 of the packing material 10 extends upwardly and downwardly along the inside of the left side wall 52 of the box 30, and the portion 44 of the packing material 10 extends upwardly and downwardly along the inside of the right side wall 54 of the box 30.

This arrangement makes it very easy for a worker to pack the laptop 28 in the box 30. He simply places the packing in the bottom of the box 30, with the troughs 22', 20', 24B', 24C' lying along the edges 62, 64, 68, 66, respectively, and with the sides 40, 44 of the packing 10 lying along the sides 52, 54 of the box 30 and the rest of the packing 10 wrapping up along the front and back 56, 58 of the box 30. Then he places the laptop 28 or other product into the box 30, resting on the packing 10 that is on the bottom 50 of the box 30, folds the packing 10 over the top of the laptop 28, with part of the sides 40, 44 extending downwardly from the top edges of the laptop along the sides of the laptop, and then he closes the top 60 of the box 30. Since the troughs define the places where the packing is folded or bent, and since they match the dimensions of the box 30, this packing arrangement is readily repeatable. Also, since there are beads 14 even in the trough areas 20', 22', 24A-C', the product 28 is well-protected, even along the troughs.

It alternatively may be decided to provide only the lengthwise parallel troughs 20', 22' and to simply align the bottom edge 15 of the packing 10 with the top front edge 70 of the box 30 and press the packing 10 down into the box 30 and then insert the product 28 and wrap the packing around the product (omitting the use of the horizontal troughs 24A-C'). It will be obvious to those skilled in the art that various other alternative arrangements of troughs could be used as well, depending upon the circumstances.

Figure 10:
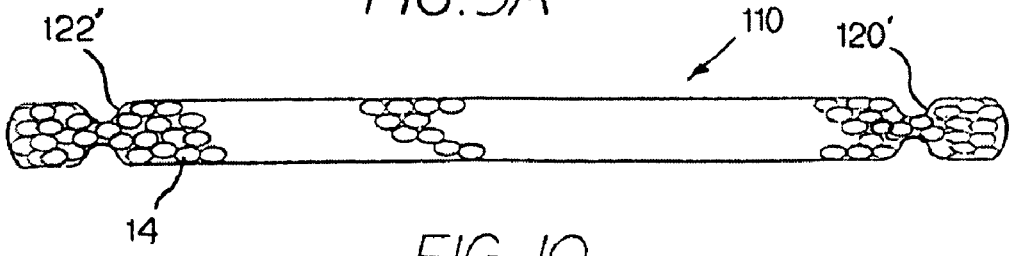
FIG. 10 is a view similar to FIG. 2 but showing an alternative embodiment.

FIG. 10 shows an alternative embodiment of a packing material 110, similar to the first embodiment, except that both of the platens that formed the packing material had raised portions which were opposite to each other, so the resulting troughs 120', 122' are indented or recessed from both sides rather than only from one side as in the first embodiment. This makes it easy to bend the packing material in both directions, both inwardly and outwardly, while the first embodiment preferably is bent inwardly. It also would be possible to have raised portions on both of the platens that are not opposed to each other, which would result in some indentations on one side and some indentations on the other side, so that some troughs are intended to be bent inwardly and other troughs are intended to be bent outwardly. For example, the raised portion 24C of the platen 16 on FIG. 5 could alternatively be placed on the platen 18, so that the trough formed by that raised portion would be on the other side of the packing material 10 from the troughs 20', 22', 24A', and 24B'. The dimensions of the raised portions of the platens and the thickness of the constant cross-section area of the packing material 110 are selected to provide enough beads 14 in the trough areas to continue to protect the product.

It will be obvious that various modifications may be made to the embodiments described above without departing from the scope of the present invention as defined by the claims.

What is claimed is:

1. A packing material, comprising:

a thin plastic bag;

a plurality of compressible beads inside the thin plastic bag, wherein the pressure inside the bag is not greater than 14.4 pounds per square inch and is sufficiently lower than the ambient pressure outside the bag to maintain the beads in a non-free-flowing state;

wherein the compressible beads are arranged so that the bag is generally flat, having a generally constant cross-sectional thickness with a first number of beads in cross-section, and with at least two parallel elongated linear troughs having a lesser cross-sectional thickness with fewer beads in cross-section while still having at least one bead in the cross-sectional thickness of the elongated troughs, and with said troughs separating said bag into at least first, second, and third areas; and a box having a rectangular bottom and rectangular left, right, front and rear sides projecting upwardly from the bottom along linear edges;

wherein the second generally constant cross-sectional thickness area covers the bottom of the box, with the first and third generally constant cross-sectional thickness areas lying along the left and right sides of the box, and with the two parallel troughs lying along two of the linear edges.

2. A packing material as recited in claim 1, and further comprising a third elongated trough extending at right angles to the two parallel elongated troughs, wherein said third elongated trough extends along a third of the linear edges.

3. A packing material, comprising:

a thin plastic bag; and a plurality of compressible beads inside the thin plastic bag, wherein the pressure inside the bag is sufficiently lower than the ambient pressure outside the bag to maintain the beads in a non-free-flowing state, and wherein the compressible beads are arranged so that the bag is generally flat, having a generally constant cross-sectional thickness with a first number of beads in cross-section, and with at least one elongated trough having a lesser cross-sectional thickness with fewer beads in cross-section while still having at least one bead in the cross-sectional thickness of the trough;

wherein said at least one elongated trough divides the bag into at least first and second portions and provides means for bending said first portion relative to said second portion.

4. A packing material, comprising:

a thin plastic bag; and a plurality of compressible beads inside the thin plastic bag, wherein the pressure inside the bag is sufficiently lower than the ambient pressure outside the bag to maintain the beads in a non-free-flowing state, and wherein the compressible beads are arranged so that the bag is generally flat, having a generally constant cross-sectional thickness with a first number of beads in cross-section, and wherein the compressible beads are arranged to form at least two parallel elongated linear troughs having a lesser cross-sectional thickness with fewer beads in cross-section while still having at least one bead in the cross-sectional thickness of the trough, with said troughs separating said bag into at least first, second, and third generally constant cross-sectional thickness areas;

wherein the pressure inside the bag is not greater than 14.4 pounds per square inch; and wherein said troughs provide means for bending said first and third portions relative to said second portion.

* * * * *

UNITED STATES PATENT AND TRADEMARK OFFICE

CERTIFICATE OF CORRECTION

PATENT NO. : 8,011,511 B2
APPLICATION NO. : 12/368761
DATED : September 6, 2011
INVENTOR(S) : Oyler et al.

It is certified that error appears in the above-identified patent and that said Letters Patent is hereby corrected as shown below:

Column 2, line 53, delete “fall” and insert therefor --full--.
Column 4, line 32, delete “ledge” and insert therefor --left edge--.

Signed and Sealed this
Twenty-first Day of February, 2012

David J. Kappos

David J. Kappos
*Director of the United States Patent and Trademark Office*